US011170716B2

(12) United States Patent
Xiao et al.

(10) Patent No.: US 11,170,716 B2
(45) Date of Patent: Nov. 9, 2021

(54) PIXEL CIRCUIT, DRIVING METHOD THEREOF, DISPLAY PANEL, AND DISPLAY DEVICE

(71) Applicant: BOE TECHNOLOGY GROUP CO., LTD., Beijing (CN)

(72) Inventors: Li Xiao, Beijing (CN); Xiaochuan Chen, Beijing (CN); Minghua Xuan, Beijing (CN); Shengji Yang, Beijing (CN); Jie Fu, Beijing (CN); Lei Wang, Beijing (CN); Dongni Liu, Beijing (CN); Pengcheng Lu, Beijing (CN); Han Yue, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 792 days.

(21) Appl. No.: 15/775,431

(22) PCT Filed: Nov. 8, 2017

(86) PCT No.: PCT/CN2017/109918
§ 371 (c)(1),
(2) Date: May 11, 2018

(87) PCT Pub. No.: WO2018/188327
PCT Pub. Date: Oct. 18, 2018

(65) Prior Publication Data

US 2021/0166627 A1 Jun. 3, 2021

(30) Foreign Application Priority Data

Apr. 14, 2017 (CN) ..... 201710243353.8

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01); *G09G 2300/0426* (2013.01)

(58) Field of Classification Search
CPC .. G09G 3/3258; G09G 3/3266; G09G 3/3291; G09G 2300/0426
See application file for complete search history.

(56) References Cited

U.S. PATENT DOCUMENTS

2003/0085828 A1 5/2003 Tsutsui
2005/0168570 A1 8/2005 Kim et al.
(Continued)

FOREIGN PATENT DOCUMENTS

CN 1413023 A 4/2003
CN 1625709 A 6/2005
(Continued)

OTHER PUBLICATIONS

International Search Report and Written Opinion from PCT/CN2017/109918 dated Feb. 7, 2018.
(Continued)

*Primary Examiner* — Kenneth B Lee, Jr.
(74) *Attorney, Agent, or Firm* — Calfee, Halter & Griswold LLP

(57) ABSTRACT

A pixel circuit includes a light emitting element; a first switch transistor connected in series with the light emitting element between a first supply voltage terminal and a second supply voltage terminal, the first switch transistor including a gate electrode connected to a first node; and a storage circuit coupled to the first node and a reference voltage terminal for receiving a reference voltage, the storage circuit being configured to store the reference voltage in the storage circuit in response to an active signal on a scan line during a write phase, and to supply the stored reference voltage to
(Continued)

the first node during a light emission phase in response to an active data signal on a data line to achieve light emission of the light emitting element, the active data signal having a duration indicating a magnitude of image data for the pixel circuit.

11 Claims, 3 Drawing Sheets

(56) References Cited

U.S. PATENT DOCUMENTS

| | | | | |
|---|---|---|---|---|
| 2015/0302798 | A1 | 10/2015 | Tan | |
| 2016/0284275 | A1 | 9/2016 | Aflatooni et al. | |
| 2017/0124948 | A1* | 5/2017 | Minami | G09G 3/3233 |

FOREIGN PATENT DOCUMENTS

| | | | |
|---|---|---|---|
| CN | 201698711 | U | 1/2011 |
| CN | 102054427 | A | 5/2011 |
| CN | 103413520 | A | 11/2013 |
| CN | 203456072 | U | 2/2014 |
| CN | 204390687 | U | 6/2015 |
| CN | 106782327 | A | 5/2017 |

OTHER PUBLICATIONS

Second Office Action for Chinese Patent Application No. 201710243353.8 dated Apr. 10, 2019.

* cited by examiner

PIXEL CIRCUIT, DRIVING METHOD THEREOF, DISPLAY PANEL, AND DISPLAY DEVICE

CROSS REFERENCE TO RELATED APPLICATIONS

This application is the U.S. national phase entry of PCT/CN2017/109918, with an international filing date of Nov. 8, 2017, which claims the benefit of Chinese Patent Application No. 201710243353.8 filed on Apr. 14, 2017, the entire disclosures of which are incorporated herein by reference.

TECHNICAL FIELD

The present disclosure relates to the field of display technology, and in particular, to a pixel circuit, a driving method thereof, a display panel, and a display device.

BACKGROUND

Electroluminescent devices such as organic light emitting diodes (OLEDs) are current-driven devices that require a stable current to maintain a stable luminance. In existing OLED displays, a pixel typically includes a light emitting diode, a drive transistor operating in a saturation region to provide an operating current for the light emitting diode, and at least one switch transistor operating in an ohmic region. The pixel circuit is often provided with additional elements to compensate for the threshold voltage of the drive transistor for luminance uniformity among pixels. This leads to an increased size of the pixel and is therefore detrimental to the improvement of the resolution of the display. In addition, even when a still image is displayed (e.g., in a digital photo frame application), the switch transistors in the pixel have to be turned on and off in every frame period, resulting in an undesirable increase in power consumption.

SUMMARY

It would be advantageous to provide a pixel circuit that alleviates, mitigates or eliminates one or more of the above problems.

According to an aspect of the present disclosure, a pixel circuit is provided including: a light emitting element; a first switch transistor connected in series with the light emitting element between a first supply voltage terminal for receiving a first supply voltage and a second supply voltage terminal for receiving a second supply voltage, the first switch transistor including a gate electrode connected to a first node; and a storage circuit coupled to the first node and a reference voltage terminal for receiving a reference voltage, the storage circuit being configured to store the reference voltage in the storage circuit in response to an active signal on a scan line during a write phase, and to supply the stored reference voltage to the first node in response to an active data signal on a data line during a light emission phase to cause the first switch transistor to be turned on to achieve light emission of the light emitting element, the active data signal having a duration indicative of a magnitude of image data for the pixel circuit.

In certain exemplary embodiments, the data line comprises a plurality of branch data lines for the pixel circuit, each of the branch data lines operable to transfer a respective active signal having a respective fixed duration. A selected subset of the plurality of branch data lines is successively supplied with respective active signals during the light emission phase, a sum of the respective fixed durations of the active signals supplied to respective branch data lines of the selected subset of branch data lines is equal to the duration of the active data signal. The storage circuit comprises a plurality of branches connected in parallel between the first node and the reference voltage terminal, each of the branches including: a storage capacitor including a first terminal and a second terminal that is connected to the second supply voltage terminal; a storage control switch transistor including a gate electrode connected to the scan line, a first electrode connected to the reference voltage terminal, and a second electrode connected to the first terminal of the storage capacitor; and a light emission control switch transistor including a gate electrode connected to a respective one of the plurality of branch data lines, a first electrode connected to the first terminal of the storage capacitor, and a second electrode connected to the first node.

In certain exemplary embodiments, the storage control switch transistor is operable to supply the reference voltage to the first terminal of the storage capacitor in response to the active signal on the scan line during the write phase.

In certain exemplary embodiments, the storage capacitor is operable to store therein the reference voltage during the write phase.

In certain exemplary embodiments, the light emission control switch transistor is operable to supply the reference voltage stored in the storage capacitor to the first node in response to the active signal on the respective branch data line during the light emission phase.

In certain exemplary embodiments, the storage circuit comprises: a single storage capacitor including a first terminal and a second terminal that is connected to the second supply voltage terminal; a single storage control switch transistor including a gate electrode connected to the scan line, a first electrode connected to the reference voltage terminal, and a second electrode connected to the first terminal of the storage capacitor; and a single light emission control switch transistor including a gate electrode connected to the data line, a first electrode connected to the first terminal of the storage capacitor, and a second electrode connected to the first node.

In certain exemplary embodiments, the storage control switch transistor is operable to supply the reference voltage to the first terminal of the storage capacitor in response to the active signal on the scan line during the write phase.

In certain exemplary embodiments, the storage capacitor is operable to store therein the reference voltage during the write phase.

In certain exemplary embodiments, the light emission control switch transistor is operable to supply the reference voltage stored in the storage capacitor to the first node in response to the active data signal on the data line during the light emission phase.

In certain exemplary embodiments, the reference voltage is equal to the first supply voltage.

According to another aspect of the present disclosure, a method of driving the pixel circuit as described above is provided which comprises: during the write phase, storing the reference voltage in response to the active signal on the scan line; and during the light emission phase, supplying the stored reference voltage to the first node in response to the active data signal on the data line such that the first switch transistor is turned on to achieve light emission of the light emitting element, the active data signal having a duration indicative of a magnitude of image data for the pixel circuit.

In certain exemplary embodiments, the write phase is performed once within a plurality of frame periods.

According to yet another aspect of the present disclosure, a display panel is provided including: a plurality of scan lines extending in a first direction; a plurality of data lines extending in a second direction intersecting the first direction; and a plurality of pixel circuits disposed at intersections of the scan lines and the data lines. Each of the plurality of pixel circuits comprises: a light emitting element; a first switch transistor connected in series with the light emitting element between a first supply voltage terminal for receiving a first supply voltage and a second supply voltage terminal for receiving a second supply voltage, the first switch transistor including a gate electrode connected to a first node; and a storage circuit coupled between the first node and a reference voltage terminal for receiving a reference voltage, the storage circuit being configured to store the reference voltage in the storage circuit in response to an active signal on a corresponding one of the scan lines during a write phase, and to supply the stored reference voltage to the first node in response to an active data signal on a corresponding one of the data lines during a light emission phase to cause the first switch transistor to be turned on to achieve light emission of the light emitting element, the active data signal having a duration indicative of a magnitude of image data for the pixel circuit.

According to still yet another aspect of the present disclosure, a display device is provided including: a plurality of scan lines extending in a first direction; a plurality of data lines extending in a second direction intersecting the first direction; a scan driver configured to sequentially supply scan signals to the scan lines; a data driver configured to supply data signals to the data lines; a timing controller configured to control operation of the scan driver and the data driver; and a plurality of pixel circuits disposed at intersections of the scan lines and the data lines. Each of the plurality of pixel circuits comprises: a light emitting element; a first switch transistor connected in series with the light emitting element between a first supply voltage terminal for receiving a first supply voltage and a second supply voltage terminal for receiving a second supply voltage, the first switch transistor including a gate electrode connected to a first node; and a storage circuit coupled between the first node and a reference voltage terminal for receiving a reference voltage, the storage circuit being configured to store the reference voltage in the storage circuit in response to an active signal on a corresponding one of the scan lines during a write phase, and to supply the stored reference voltage to the first node in response to an active data signal on a corresponding one of the data lines during a light emission phase to cause the first switch transistor to be turned on to achieve light emission of the light emitting element, the active data signal having a duration indicative of a magnitude of image data for the pixel circuit.

In certain exemplary embodiments, the corresponding data line comprises a plurality of branch data lines for the pixel circuit, each of the branch data lines being operable to transfer a respective active signal. The data driver is configured to allocate to the plurality of branch data lines respective fixed durations in which the respective active signals are supplied. The data driver is further configured to, during the light emission phase, select a subset of the plurality of branch data lines according to the image data for the pixel circuit and successively supply the respective active signals to respective branch data lines of the selected subset of branch data lines, a sum of the respective fixed durations of the active signals supplied to the respective branch data lines of the selected subset of branch data lines is equal to the duration of the active data signal. The storage circuit comprises a plurality of branches connected in parallel between the first node and the reference voltage terminal, each of the branches including: a storage capacitor including a first terminal and a second terminal that is connected to the second supply voltage terminal; a storage control switch transistor including a gate electrode connected to the corresponding scan line, a first electrode connected to the reference voltage terminal, and a second electrode connected to the first terminal of the storage capacitor; and a light emission control switch transistor including a gate electrode connected to a respective one of the plurality of branch data lines, a first electrode connected to the first terminal of the storage capacitor, and a second electrode connected to the first node.

In certain exemplary embodiments, a number of branch data lines and a number of branches are each equal to a bit depth of the image data for the pixel circuit, and the data driver is configured such that the respective fixed durations allocated to the plurality of branch data lines respectively indicate magnitudes represented by bits in the bit depth.

In certain exemplary embodiments, the timing controller is configured such that the scan driver supplies the scan signals to the scan lines every multiple frame periods.

These and other aspects of the present disclosure will be apparent from and elucidated with reference to the embodiment(s) described hereinafter.

BRIEF DESCRIPTION OF THE DRAWINGS

Further details, features and advantages of the disclosure are disclosed in the following description of exemplary embodiments in connection with the accompanying drawings, in which.

DETAILED DESCRIPTION

It will be understood that, although the terms first, second, third etc. may be used herein to describe various elements, components and/or sections, these elements, components and/or sections should not be limited by these terms. These terms are only used to distinguish one element, component or section from another. Thus, a first element, component or section discussed below could be termed a second element, component or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element is referred to as being "connected to" or "adjacent to" another element, it can be directly connected or adjacent to the other element or intervening elements may be present. In contrast, when an element is referred to as being "directly connected to" or "immediately adjacent to" another element, there are no intervening elements present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

The term "active signal" as used herein refers to a signal that enables a circuit element (e.g., a transistor) involved. For example, for an n-type transistor, the active signal is a signal with a high potential, and for a p-type transistor, the active signal is a signal with a low potential.

Embodiments of the present disclosure will be described in detail below with reference to the accompanying drawings.

Figure 1:
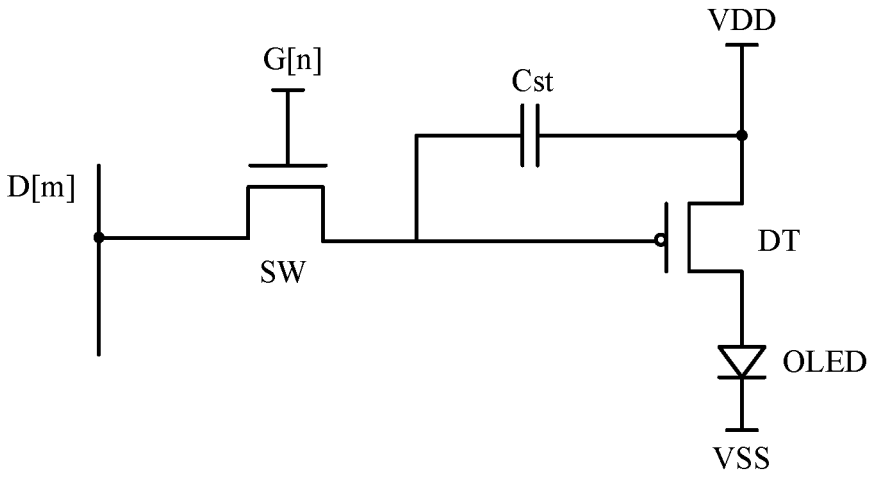
(Related Art) FIG. 1
FIG. 1 is a circuit diagram of a typical 2T1C pixel.

FIG. 1 is a circuit diagram of a typical 2T1C pixel. As shown in FIG. 1, the pixel includes a light emitting element illustrated as an OLED, a drive transistor DT, a storage capacitor Cst, and a switch transistor SW.

In operation, the switch transistor SW is turned on in response to an active signal on a scan line G[n], and a data voltage on a data line D[m] is written in the storage capacitor Cst. Then, the switch transistor SW is turned off in response to an inactive signal on the scan line G[n], and the drive transistor DT operates in a saturation region in response to a voltage across the storage capacitor Cst. The drive transistor DT generates and supplies the light emitting element OLED with a saturation current related to the data voltage and the threshold voltage of the drive transistor DT. As such, the light emitting element OLED exhibits a luminance that corresponds to the data voltage.

The pixel shown in FIG. 1 is not provided with additional elements for compensating for the threshold voltage of the drive transistor DT, and therefore nonuniformity in luminance is expected among the pixels in the case of the same data voltage. Moreover, even when a still image is displayed (for example, in a digital photo frame application), the switch transistor SW has to be turned on and off in every frame period in order to write the (potentially the same) data voltage into the storage capacitor Cst. Switching the switch transistor between on and off may result in unnecessary increase in the power consumption.

Figure 2:
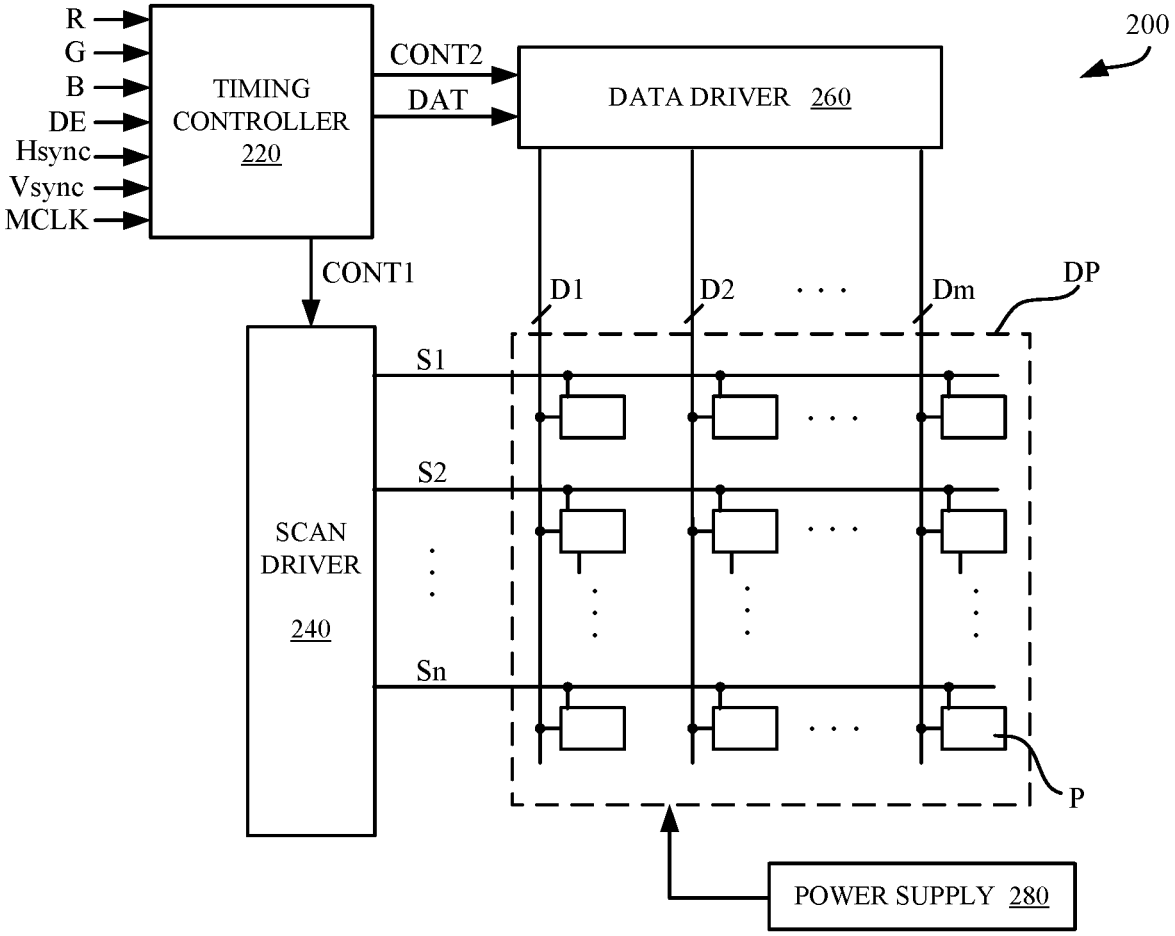
FIG. 2 is a schematic block diagram of a display device according to an embodiment of the present disclosure.

FIG. 2 is a schematic block diagram of a display device 200 according to an embodiment of the present disclosure. Referring to FIG. 2, the display device 200 includes a display panel DP, a timing controller 220, a scan driver 240, a data driver 260, and a power supply 280.

The display panel DP includes n×m pixels P. The configuration of the pixel P will be discussed in detail below in connection with FIGS. 3-7. The display panel DP includes n scan lines S1, S2, . . . Sn arranged in a first direction (row direction in the figure) to transfer scan signals; m data lines D1, D2, . . . Dm arranged in a second direction (column direction in the figure) intersecting the first direction to transfer data signals; and m first wires (not shown) and m second wires (not shown) for applying a first and second power supply voltages VDD and VSS. n and m are natural numbers.

The timing controller 220 receives synchronization signals and video signals R, G, and B from a system interface. The video signals R, G, and B contain luminance information for each of the plurality of pixels P, wherein the luminance has a predetermined number of grayscales, for example, 1024 ($=2^{10}$), 256 ($=2^{8}$), or 64 ($=2^{6}$) grayscales. The synchronization signals include a horizontal synchronization signal Hsync, a vertical synchronization signal Vsync, a master clock signal MCLK, and a data enable signal DE. The timing controller 220 generates a first driving control signal CONT1, a second driving control signal CONT2, and image data based on the video signals R, G, and B, the horizontal synchronization signal Hsync, the vertical synchronization signal Vsync, the data enable signal DE, and the master clock signal MCLK Signal DAT. The timing controller 220 divides the video signals R, G, and B into units of frames according to the vertical synchronization signal Vsync, and divides the video signals R, G, and B into units of data lines according to the horizontal synchronization signal Hsync to generate an image data signal DAT. The timing controller 220 transfers the image data signal DAT and the second driving control signal CONT2 to the data driver 260.

The scan driver 240 is coupled to the scan lines S1, S2, . . . Sn, and generates a plurality of scan signals according to the first driving control signal CONT1. The scan driver 240 may sequentially apply the plurality of scan signals to the display panel DP via the scan lines S1, S2, . . . Sn.

The data driver 260 is coupled to the data lines D1, D2, . . . Dm. The data driver 260 generates a plurality of data signals from the image data signal DAT according to the second driving control signal CONT2 and applies them to the data lines D1 to Dm. As will be discussed later, the data driver 260 supplies the data signals to the pixels P in the display panel DP during a light emission phase.

The power supply 280 applies the first power supply voltage VDD and the second power supply voltage VSS to each of the pixels P in the display panel DP.

The scan driver 240 and/or the data driver 260 may be set (e.g., integrated) in the display panel DP. Alternatively, the scan driver 240 and/or the data driver 260 may be connected to the display panel DP, for example, through a Tape Carrier Package (TCP).

By way of example and not limitation, the display device 200 may be any product or component having a display function such as a mobile phone, a tablet computer, a television, a display, a notebook computer, a digital photo frame, a navigator, and the like.

Figure 3:
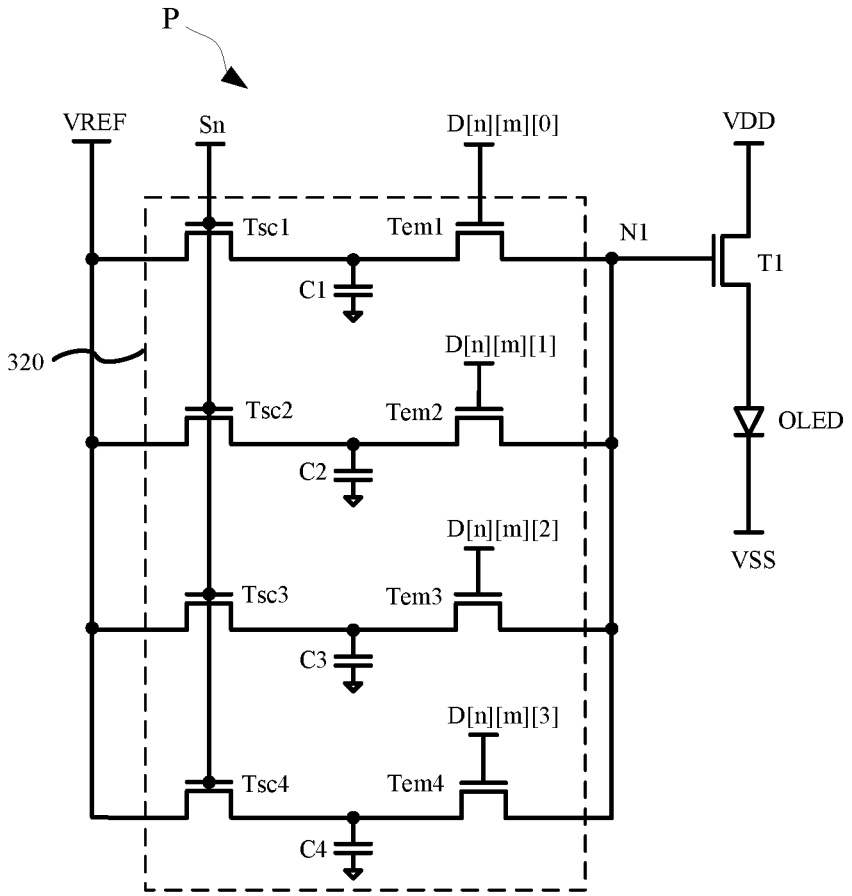
FIG. 3 is a circuit diagram of an example circuit of a pixel in the display device shown in FIG. 2.

FIG. 3 is a circuit diagram of an example circuit of the pixel P in the display device 200 shown in FIG. 2. Referring to FIG. 3, the pixel P includes a light emitting element OLED, a first switch transistor T1, and a storage circuit 320. The illustrated pixel P is located at the n-th row and m-th column of the pixel array in the display panel DP of FIG. 2.

The light emitting element OLED may be an organic light emitting diode or other similar electroluminescent element.

The first switch transistor T1 and the light emitting element OLED are connected in series between a first supply voltage terminal for receiving the first power supply voltage VDD and a second supply voltage terminal for receiving the second power supply voltage VSS. The first switch transistor T1 includes a gate electrode connected to a first node N1.

The storage circuit 320 is coupled between the first node N1 and a reference voltage terminal for receiving a reference voltage VREF. The storage circuit 320 is configured to store the reference voltage VREF in the storage circuit 320 in response to an active signal on the scan line Sn during a write phase. The storage circuit 320 is also configured to supply the stored reference voltage VREF to the first node N1 in response to an active data signal on the data line connected to the pixel P during the light emission phase so that the first switch transistor T1 is turned on to achieve light emission of the light emitting element OLED.

The pixel P differs from the pixel shown in FIG. 1 in that it does not include a drive transistor operating in a saturation region and therefore does not require additional elements for compensating the threshold voltage of the drive transistor. In particular, the first switch transistor T1 operates in the ohmic region and acts as a switch. When the first node N1 is at a high level, the first switch transistor T1 is turned on and the light emitting element OLED is lighted. When the first node N1 is at a low level, the first switch transistor T1 is turned off and the light emitting element OLED is extinguished. By controlling the on/off of the first switch transistor T1, the duration in which the light emitting element OLED is lighted can be controlled. This can be regarded as pulse width modulation where the average light intensity per frame period of the light emitting element OLED (in other words, the grayscale exhibited) is determined by the duty ratio of a voltage applied to the first node N1. Therefore, by means of the storage circuit 320 controlling the duty ratio of the voltage at the first node N1 in accordance with the image data for the pixel P, the pixel P can exhibit a grayscale corresponding to the image data. This may be particularly advantageous for applications in which a still image is to be displayed, because in this case the average light intensity per frame period of the light emitting element OLED maintains stable in the long term, and thus can be easily perceived as a corresponding grayscale.

In this example, the duty ratio corresponding to the magnitude of the image data for the pixel P is provided by a combination of different portions of the storage circuit 320. Specifically, the data line connected to the pixel P includes a plurality of branch data lines, and the storage circuit 320 includes a plurality of branches connected in parallel between the first node N1 and the reference voltage VREF. In FIG. 3, four branch data lines are shown, which are D[n][m][0], D[n][m][1], D[n][m][2] and D[n][m][3]. Also, four branches are shown, which are: 1) a first branch including a storage control switch transistor Tsc1, a storage capacitor C1, and a light emission control switch transistor Tem1; 2) a second branch including a storage control switch transistor Tsc2, a storage capacitor C2, and a light emission control switch transistor Tem2; 3) a third branch including a storage control switch transistor Tsc3, a storage capacitor C3, and a light emission control switch transistor Tem3; and 4) a fourth branch including a storage control switch transistor Tsc4, a storage capacitor C4, and a light emission control switch transistor Tem4. In the first branch, the storage capacitor C1 includes a first terminal and a second terminal that is connected to the second supply voltage VSS (indicated by a triangle in the figure). The storage control switch transistor Tsc1 includes a gate electrode connected to the scan line Sn, a first electrode connected to the reference voltage VREF, and a second electrode connected to the first terminal of the storage capacitor C1. The light emission control switch transistor Tem1 includes a gate electrode connected to the branch data line D[n][m][0], a first electrode connected to the first terminal of the storage capacitor C1, and a second electrode connected to the first node N1. The configurations of the remaining three branches are similar to that of the first branch, the description of which is therefore omitted here. The storage capacitors C1, C2, C3, and C4 may or may not have the same capacitance.

The plurality of branch data lines D[n][m][0], D[n][m][1], D[n][m][2], and D[n][m][3] are allocated by the data driver 260 (FIG. 2) with respective fixed durations in which the active signal is supplied, which fixed durations respectively indicate the magnitudes represented by the bits in the bit depth of the image data for the pixel P. In the example of FIG. 3, assuming that the image data has a bit depth of 4 (i.e., 4-bit image data), the respective fixed durations allocated to the branch data lines D[n][m][0], D[n][m][1], D[n][m][2] and D[n][m][3] can respectively indicate the magnitudes represented by the least significant bit (LSB), the second-least-significant bit, the second-most-significant bit, and the most significant bit (MSB) of the image data, or equivalently 1 ($=2^0$), 2 ($=2^1$), 4 ($=2^2$), and 8 ($=2^3$).

During the light emission phase, the data driver 260 selects, in accordance with the image data for the pixel P, a subset of the plurality of branch data lines D[n][m][0], D[n][m][1], D[n][m][2] and D[n][m][3] and successively supplies respective active signals to the respective branch data lines of the selected subset of branch data lines. The sum of the respective fixed durations of the respective active signals supplied to the respective branch data lines of the selected subset of branch data lines is equal to the duration corresponding to the magnitude of the image data for the pixel P. It will be understood that the term "subset" may refer to an empty set or a full set.

Figure 4:
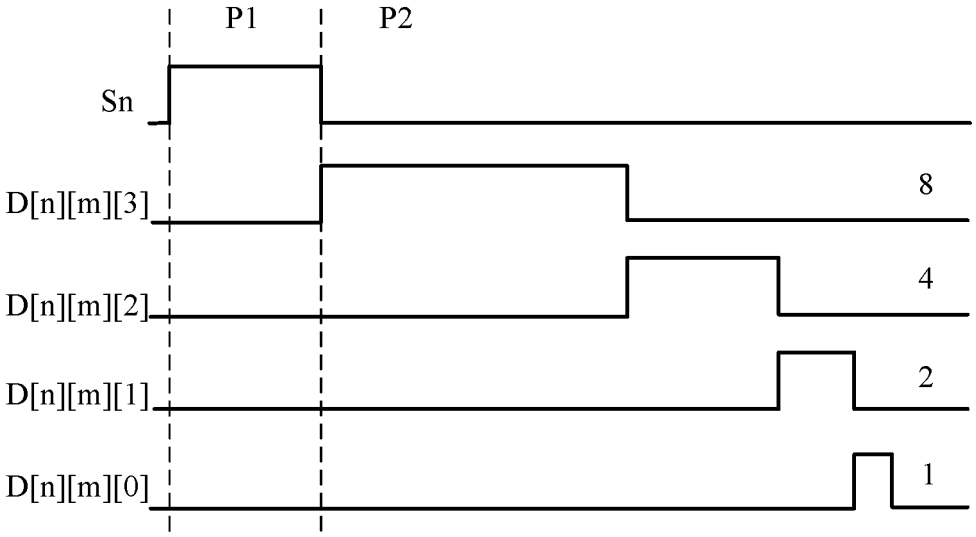
FIG. 4 is an example timing diagram of the pixel circuit shown in FIG. 3.

FIG. 4 is an example timing diagram of the pixel circuit shown in FIG. 3. The operation of the pixel P will be described below with reference to FIGS. 3 and 4.

During a write phase P1, the storage circuit 320 stores the reference voltage VREF in the storage circuit 320 in response to an active signal on the scan line Sn. Specifically, the storage control switch transistors Tsc1, Tsc2, Tsc3, and Tsc4 are turned on so that the storage capacitors C1, C2, C3, and C4 are charged with the reference voltage VREF through the storage control switch transistors Tsc1, Tsc2, Tsc3, and Tsc4, respectively. In some embodiments, the reference voltage VREF may be equal to the first power voltage VDD. This can simplify the power supply of the pixel circuit.

During a light emission phase P2, the storage circuit 320 supplies the stored reference voltage VREF to the first node N1 in response to an active data signal on the data line so that the first switch transistor T1 is turned on to achieve light emission of the light emitting element OLED. Specifically, the data driver 260 selects a subset of the branch data lines D[n][m][0], D[n][m][1], D[n][m][2] and D[n][m][3] according to the image data for the pixels P and successively supplies respective active signals to the respective branch data lines of the selected subset of branch data lines such that the sum of the respective fixed durations of the respective active signals supplied to the respective branch data lines of the selected subset of branch data lines is equal to the duration corresponding to the magnitude of the image data for the pixel P. In the example of FIG. 4, the magnitude of 4-bit image data is 15 (1111 in binary). Thus, all the branch data lines D[n][m][0], D[n][m][1], D[n][m][2] and D[n][m][3] are selected and successively transfer respective active signals (which have durations indicating the magnitudes of 1, 2, 4 and 8, respectively). This causes the light emitting element OLED to emit light for a duration corresponding to the magnitude of 15 in the current frame period.

Figure 5:
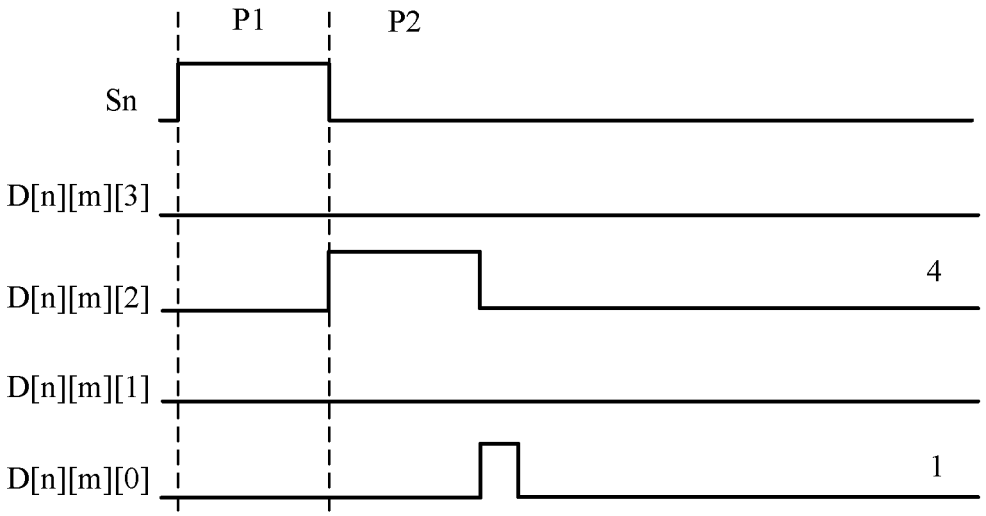
FIG. 5 is another example timing diagram of the pixel circuit shown in FIG. 3.

FIG. 5 is another example timing diagram of the pixel circuit shown in FIG. 3.

This timing diagram differs from the timing diagram shown in FIG. 4 in that the 4-bit image data for the pixel P has a magnitude of 5 (0101 in binary), and thus during the light emission phase P3 only the data line D[n][ m][0] and D[n][m][2] are selected and successively transfer respective active signals (which have durations indicating the magnitudes of 1 and 4, respectively). This causes the light emitting element OLED to emit light for a duration corresponding to the magnitude of 5 in the current frame period.

Figure 6:
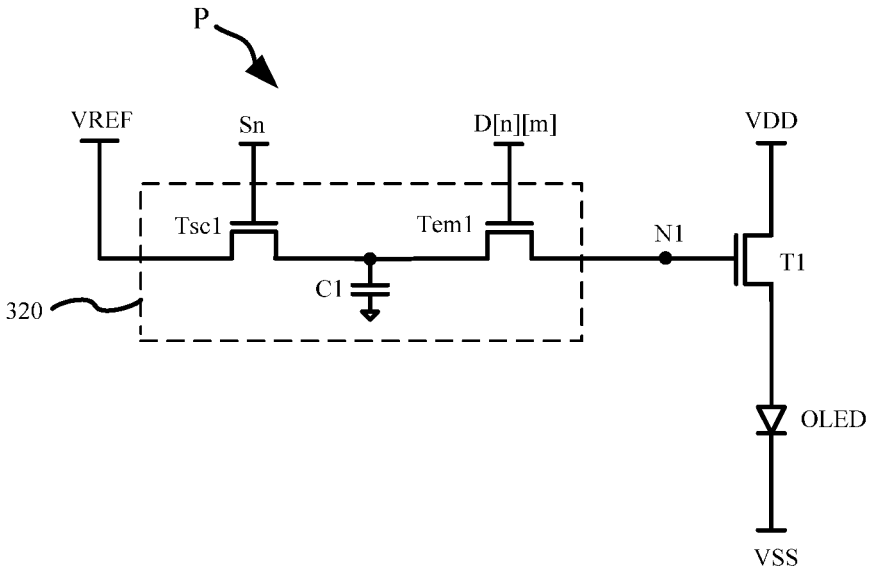
FIG. 6 is a circuit diagram of another example circuit of a pixel in the display device shown in FIG. 2.

FIG. 6 is a circuit diagram of another exemplary circuit of the pixel P in the display device 200 shown in FIG. 2. Referring to FIG. 6, the pixel P includes a light emitting element OLED, a first switch transistor T1, and a storage circuit 320. The illustrated pixel P is located at the n-th row and m-th column of the pixel array in the display panel DP of FIG. 2. The configurations of the light emitting element OLED and the first switch transistor T1 are the same as those described above with respect to FIG. 3, the description of which is thus omitted here.

Unlike the example of FIG. 3, the pixel P shown in FIG. 6 is connected to the data driver 260 (FIG. 2) only through a single data line D[n][m], and accordingly, the storage circuit 320 includes only a single branch, which includes a single storage capacitor C1, a single storage control switch transistor Tsc1, and a single light emission control switch transistor Tem1. Specifically, the storage capacitor C1 includes a first terminal and a second terminal that is connected to the second power supply voltage VSS. The storage control switch transistor Tsc1 includes a gate electrode connected to the scan line Sn, a first electrode connected to the reference voltage VREF, and a second electrode connected to the first terminal of the storage capacitor C1. The light emission control switch transistor Tem1 includes a gate electrode connected to the data line D[n][m], a first electrode connected to the first terminal of the storage capacitor C1, and a second electrode connected to the first node N1. The pixel P now includes only a single branch, which is advantageous for reducing the size of the pixel P and the cost of the display device.

During the light emission phase, the data driver 260 (FIG. 2) supplies an active data signal to the pixel P through the data line D[n][m], which has a duration indicating the magnitude of the image data for the pixel P.

Figure 7:
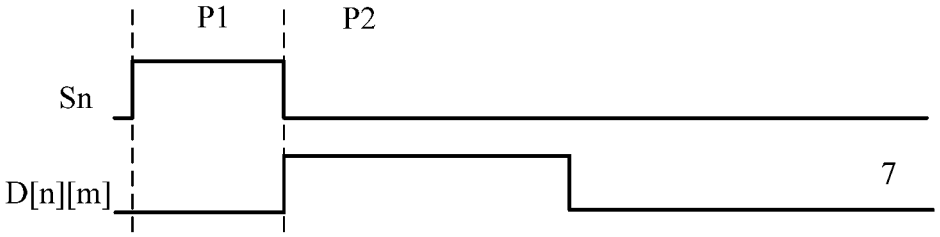
FIG. 7 is an example timing diagram of the pixel circuit shown in FIG. 6.

FIG. 7 is an example timing diagram of the pixel circuit shown in FIG. 6. The operation of the pixel P will be described below with reference to FIGS. 6 and 7.

During the write phase P1, the storage circuit 320 stores the reference voltage VREF in the storage circuit 320 in response to an active signal on the scan line Sn. Specifically, the storage control switch transistor Tsc1 is turned on so that the storage capacitor C1 is charged with the reference voltage VREF through the storage control switch transistor Tsc1.

During the light emission phase P2, the storage circuit 320 supplies the stored reference voltage VREF to the first node N1 in response to an active data signal on the data line D[n][m] so that the first switch transistor T1 is turned on to achieve light emission of the light emitting element OLED. As described earlier, the active data signal supplied by the data driver 260 has a duration indicating the magnitude (7 in the example of FIG. 7) of the image data for the pixel P. This causes the light emitting element OLED to emit light for a duration corresponding to the magnitude of 7 in the current frame period, thereby exhibiting grayscales corresponding to the image data.

It will be understood that in various embodiments, the write phase P1 does not need to be performed in every frame period but may be performed every certain number of frame periods. This may be achieved by configuring the timing controller 220 such that the scan driver 240 supplies active scan signals to the scan lines every multiple frame periods. In this case, the first switch transistor T1 may still be turned on during the multiple frame periods to achieve light emission of the light emitting element OLED because the voltage stored in the storage capacitor may generally remain unchanged for several frame periods or drop by only a small amount. Therefore, the storage capacitor does not need to be charged every frame period. This can avoid frequent turning on/off of the storage control switch transistor, thereby saving power consumption.

It will also be understood that in various embodiments, although the transistors are illustrated and described as n-type transistors, p-type transistors are possible. In the case of a p-type transistor, the gate-on voltage has a low level, and the gate-off voltage has a high level. In various embodiments, the transistors may, for example, be thin film transistors, which are typically fabricated so that their first and second electrodes can be used interchangeably, although other embodiments are also contemplated.

Although some exemplary embodiments of the present disclosure have been described above, changes may be made by those skilled in the art to these exemplary embodiments without departing from the principle or spirit of the present disclosure. The scope of the disclosure is defined by the claims and equivalents thereof.

What is claimed is:

1. A pixel circuit, comprising:

a light emitting element;

a first switch transistor connected in series with the light emitting element between a first supply voltage terminal for receiving a first supply voltage and a second supply voltage terminal for receiving a second supply voltage, the first switch transistor comprising a gate electrode connected to a first node; and a storage circuit coupled to the first node and a reference voltage terminal for receiving a reference voltage, wherein the storage circuit is configured to store the reference voltage in the storage circuit in response to an active signal on a scan line during a write phase, and wherein the storage circuit is configured to supply the stored reference voltage to the first node in response to an active data signal on a data line during a light emission phase to cause the first switch transistor to be turned on to achieve light emission of the light emitting element, wherein the active data signal has a duration indicative of a magnitude of image data for the pixel circuit, wherein the data line comprises a plurality of branch data lines for the pixel circuit, wherein each of the branch data lines operable to transfer a respective active signal having a respective fixed duration, wherein a selected subset of the plurality of branch data lines is successively supplied with respective active signals during the light emission phase, wherein a sum of the respective fixed durations of the active signals supplied to respective branch data lines of the selected subset of branch data lines is equal to the duration of the active data signal, and wherein the storage circuit comprises a plurality of branches connected in parallel between the first node and the reference voltage terminal, each of the branches comprising:

a storage capacitor comprising a first terminal and a second terminal, wherein the second terminal is connected to the second supply voltage terminal;

a storage control switch transistor comprising:

a gate electrode connected to the scan line, a first electrode connected to the reference voltage terminal, and a second electrode connected to the first terminal of the storage capacitor; and a light emission control switch transistor comprising:

a gate electrode connected to a respective one of the plurality of branch data lines, a first electrode connected to the first terminal of the storage capacitor, and a second electrode connected to the first node.

2. The pixel circuit of claim 1, wherein the storage control switch transistor is operable to supply the reference voltage to the first terminal of the storage capacitor in response to the active signal on the scan line during the write phase.

3. The pixel circuit of claim 2, wherein the storage capacitor is operable to store the reference voltage during the write phase.

4. The pixel circuit of claim 3, wherein the light emission control switch transistor is operable to supply the reference voltage stored in the storage capacitor to the first node in response to the active signal on the respective branch data line during the light emission phase.

5. The pixel circuit of claim 1, wherein the reference voltage is equal to the first supply voltage.

6. A method of driving a pixel circuit, comprising:

providing the pixel circuit, which comprises:

a light emitting element;

a first switch transistor connected in series with the light emitting element between a first supply voltage terminal for receiving a first supply voltage and a second supply voltage terminal for receiving a second supply voltage, the first switch transistor comprising:

a gate electrode connected to a first node; and a storage circuit coupled to the first node and a reference voltage terminal for receiving a reference voltage, wherein the storage circuit is configured to store the reference voltage in the storage circuit in response to an active signal on a scan line during a write phase and to supply the stored reference voltage to the first node in response to an active data signal on a data line during a light emission phase to cause the first switch transistor to be turned on to achieve light emission of the light emitting element, wherein the active data signal has a duration indicative of a magnitude of image data for the pixel circuit;

wherein the data line comprises a plurality of branch data lines for the pixel circuit, wherein each of the branch data lines operable to transfer a respective active signal having a respective fixed duration, wherein a selected subset of the plurality of branch data lines is successively supplied with respective active signals during the light emission phase, wherein a sum of the respective fixed durations of the active signals supplied to respective branch data lines of the selected subset of branch data lines is equal to the duration of the active data signal, and wherein the storage circuit comprises a plurality of branches connected in parallel between the first node and the reference voltage terminal, each of the branches comprising:

a storage capacitor comprising a first terminal and a second terminal, wherein the second terminal is connected to the second supply voltage terminal;

a storage control switch transistor comprising:

a gate electrode connected to the scan line, a first electrode connected to the reference voltage terminal, and a second electrode connected to the first terminal of the storage capacitor; and a light emission control switch transistor comprising:

a gate electrode connected to a respective one of the plurality of branch data lines, a first electrode connected to the first terminal of the storage capacitor, and a second electrode connected to the first node, during the write phase, storing the reference voltage in response to the active signal on the scan line; and during the light emission phase, supplying the stored reference voltage to the first node in response to the active data signal on the data line such that the first switch transistor is turned on to achieve light emission of the light emitting element.

7. The method of claim 6, wherein the write phase is performed once within a plurality of frame periods.

8. A display panel, comprising:

a plurality of scan lines extending in a first direction;

a plurality of data lines extending in a second direction intersecting the first direction; and a plurality of pixel circuits disposed at intersections of the scan lines and the data lines, each of the plurality of pixel circuits comprising:

a light emitting element;

a first switch transistor connected in series with the light emitting element between a first supply voltage terminal for receiving a first supply voltage and a second supply voltage terminal for receiving a second supply voltage, wherein the first switch transistor comprises: a gate electrode connected to a first node; and a storage circuit coupled between the first node and a reference voltage terminal for receiving a reference voltage, wherein the storage circuit is configured to store the reference voltage in the storage circuit in response to an active signal on a corresponding one of the scan lines during a write phase, and wherein the storage circuit is configured to supply the stored reference voltage to the first node in response to an active data signal on a corresponding one of the data lines during a light emission phase to cause the first switch transistor to be turned on to achieve light emission of the light emitting element, wherein the active data signal has a duration indicative of a magnitude of image data for the pixel circuit, wherein each corresponding data line comprises a plurality of branch data lines for the pixel circuit, wherein each of the branch data lines is operable to transfer a respective active signal having a respective fixed duration, wherein during the light emission phase a selected subset of the plurality of branch data lines is successively supplied with respective active signals, a sum of the respective fixed durations of the active signals supplied to respective branch data lines of the selected subset of branch data lines is equal to the duration of the active data signal, and wherein the storage circuit comprises a plurality of branches connected in parallel between the first node and the reference voltage terminal, each of the branches comprising:

a storage capacitor comprising a first terminal and a second terminal that is connected to the second supply voltage terminal;

a storage control switch transistor comprising:

a gate electrode connected to the corresponding scan line, a first electrode connected to the reference voltage terminal, and a second electrode connected to the first terminal of the storage capacitor; and a light emission control switch transistor comprising:

a gate electrode connected to a respective one of the plurality of branch data lines, a first electrode connected to the first terminal of the storage capacitor, and a second electrode connected to the first node.

9. A display device, comprising:

the display panel as recited in claim 8;

a scan driver configured to sequentially supply scan signals to the scan lines;

a data driver configured to supply data signals to the data lines; and a timing controller configured to control operation of the scan driver and the data driver.

10. The display device of claim 9, wherein a number of branch data lines and a number of branches are each equal to a bit depth of the image data for the pixel circuit, and wherein the data driver is configured such that the respective fixed durations allocated to the plurality of branch data lines respectively indicate magnitudes represented by bits in the bit depth.

11. The display device of claim 9, wherein the timing controller is configured to control the scan driver such that the scan driver supplies the scan signals to the scan lines every multiple frame periods.

* * * * *